United States Patent [19]

Lindae et al.

[11] Patent Number: 5,014,173

[45] Date of Patent: May 7, 1991

[54] LOW BEAM OR FOG HEADLAMP FOR MOTOR VEHICLES

[75] Inventors: Gerhard Lindae, Leonberg; Richard Loewe, Gerlingen; Peter Perthus, Stuttgart, all of Fed. Rep. of Germany

[73] Assignee: Robert Bosch GmbH, Stuttgart, Fed. Rep. of Germany

[21] Appl. No.: 236,008

[22] Filed: Aug. 23, 1988

Related U.S. Application Data

[62] Division of Ser. No. 926,960, Nov. 3, 1986, Pat. No. 4,796,171.

[30] Foreign Application Priority Data

Nov. 7, 1985 [DE] Fed. Rep. of Germany ..... 3539452
Jan. 26, 1986 [DE] Fed. Rep. of Germany ..... 3602262

[51] Int. Cl.[5] ..... F21V 7/00; F21V 5/04

[52] U.S. Cl. ..... 362/309; 362/327; 362/332; 362/335

[58] Field of Search ..... 362/61, 80, 309, 332, 362/336, 338, 327, 335

[56] References Cited

U.S. PATENT DOCUMENTS

| | | | |
|---|---|---|---|
| 1,601,688 | 9/1926 | Nyström | 362/336 |
| 3,431,449 | 3/1969 | Hundley | 362/309 X |
| 4,100,594 | 7/1978 | Gould | 362/308 |
| 4,238,817 | 12/1980 | Fratty | 362/309 |
| 4,305,119 | 12/1981 | Draper et al. | 362/332 X |
| 4,608,623 | 8/1986 | Stephano | 362/309 X |

*Primary Examiner*—Stephen F. Husar
*Assistant Examiner*—Peggy Neils
*Attorney, Agent, or Firm*—Michael J. Striker

[57] ABSTRACT

A low beam headlamp for motor vehicles includes an objective made of pressed glass whose one side is formed as aspheric partial surfaces of identical or different asphericity. The partial surfaces are staggered in the direction parallel to the optical axis of the objective and the resulting step has rounded edges. The aspheric partial surfaces adjust light distribution to achieve a desired quality of the light-dark boundary zone projected on the driveway, and provide corrected color fringes of the passing light beam.

2 Claims, 2 Drawing Sheets

LOW BEAM OR FOG HEADLAMP FOR MOTOR VEHICLES

This is a division of application Ser. No. 926,960, filed Nov. 3, 1986, now U.S. Pat. No. 4,796,171.

BACKGROUND OF THE INVENTION

The present invention relates to a low beam or fog headlamp for motor vehicles, including a reflector which by reflecting light rays from a light source generates a beam of light directed past an optically effective edge of a light shield into an objective which in turn projects a partial light beam at the edge of the light shield as a light-dark boundary zone on a driveway.

In known headlamps of this kind the light distribution of the projected light beam is determined substantially by the shape of the reflector. In addition, it has been devised to suppress or completely eliminate interfering and undesirable color fringes of the light beam by additional optical means.

For this purpose, additional separate devices have been used in the headlamp which of necessity cost an increased technological expense and in the case of extreme operational conditions, impair the functional safety of the reflector.

SUMMARY OF THE INVENTION

It is, therefore, a general object of this invention to avoid these disadvantages. In particular, it is an object of this invention to provide such an improved headlamp which effectively adjusts the distribution of the projected light beam so as to obtain the desired quality of the light-dark boundary on the driveway and corrects the undesirable color fringes at reduced cost and without impairing the operational safety of the lamp.

In keeping with these objects and others which will become apparent hereafter, one feature of the headlamp according to this invention resides in the provision of optical means in the form of at least two aspheric surface portions which are an integral part of the surface of the objective and which are shaped in such a manner as to adjust the desired light distribution and correct the color fringes of the projected light beam.

In an embodiment the optical means are in the form of aspheric partial surfaces on one side of the objective whereby the configuration, shape and curvature of respective partial surfaces can be uniform or can differ from one surface to another. In another embodiment, one side of the objective is not rotation symmetrical whereby axial sections of this one side continuously change according to a variable of a lens formula which will be described below. In another embodiment the, one side of the objective has at least partially a light dispersing profile.

If in the low beam or fog headlamp for motor vehicles a so called projecting optical system is used then a sharp projection of the light-dark boundary zone is achieved on the driveway, that means the transition from light to dark is immediate. It is true that such a sharp light-dark boundary meets the requirements of ECE-regulations, nevertheless a certain amount of nonsharpness of the light-dark boundary is desirable and for headlamps which are permissible in the U.S.A., such a nonsharpness is even required. In order to introduce such a desirable nonsharpness of the boundary line, aspheric optical means which are integrally connected with the objective are shaped for producing on its upper surface a light dispersion in a predetermined range. Preferably, the surface dispersion of light in a predetermined range is achieved by forming the aspheric partial surfaces with microdeformations, particularly with microelevations. In the film projection technology such dispersing microelements are in the form of a so-called pitting or orange peel structure on at least one lens surface of the illumination optical system (condensor), thus dispersing the image of the illuminating body which is projected in the image window of the projector. However, the microelevations on a lens of a projecting optical system (that means on the projecting objective) in the film projection technology is an unavoidable shortcoming. In a motor vehicle headlamp operating with a light projecting system, a reflector is provided with a condensor and in comparison to film projection technology it is essential that the microelevations be intentionally introduced into the light projecting optical system.

A preferable range of the nonsharpness of the light-dark boundary is achieved by simple means in such a manner that an angle included by a tangent line of a microelevation, with an ideal surface contour of the objective does not exceed a predetermined value of about 5°. The microelevations are preferably produced by pressing the glass objective in a form or mold whereby the microelevations are impressed in the aspheric surface portions.

The desired nonsharpness of the projected light-dark boundary line can be also achieved when only a partial surface of the objective lens is provided with the microelevations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
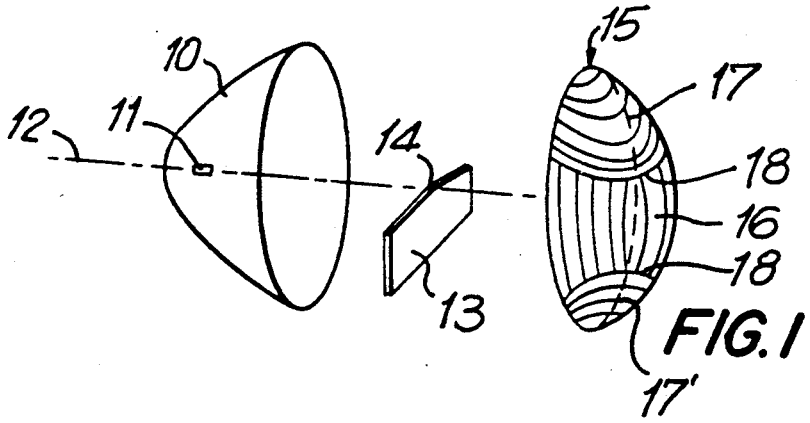
FIG. 1 is a schematic perspective view of a low beam headlamp for motor vehicles including a first embodiment of an objective.

Referring firstly to FIG. 1, the illustrated low beam or fog light headlamp for motor vehicles includes a reflector 10 defining an optical axis 12 on which a light source 11 is situated. Nonillustrated light rays emanating from the light source 11 are reflected on the inner surface of the reflector 11 into a light beam propagating in the direction of the optical axis. In the path of propagation of the light beam are consecutively arranged a light shield 13 having an optically effective edge 14, and an objective 15 made of pressed glass. The objective projects the edge of the shield 13 as light-dark boundary zone of the projected partial light beam on a driveway.

Figure 4:
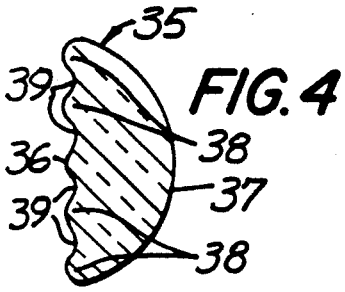
FIG. 4 is an axial section of a third embodiment of an objective.

A side of the objective 15 adverting from the reflector 10 includes an intermediate aspheric partial surface 16, an upper aspheric partial surface 17 and a lower aspheric partial surface 17'. In this embodiment, the configuration and the curvature of the aspheric partial surface 18 differ from those of the upper and lower aspheric partial surfaces 17, 17'. The adjoining aspheric partial surfaces 16, 17 and 16, 17' contact one another along contact lines 18 whereby in this embodiment each contact line 18 lies on a convex surface. In modifications, respective contact lines can lie on a flat surface (FIG. 5) or delimit an annular surface (FIG. 4). The aspheric partial surfaces 16, 17 and 17' constitute optical means forming an integral part of at least one side of the objective 15 to influence the light distribution and to correct color fringes of the projected light beam. The desired light distribution and color fringe correction is achieved by adjusting the asphericity.

Figure 2:
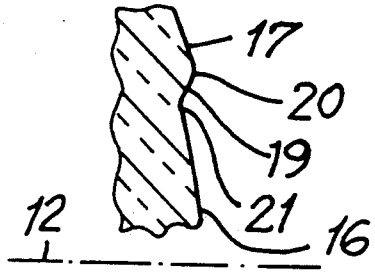
FIG. 2 is an axial cross section of a cutaway part of a side of the objective of FIG. 1 shown in the range of two adjoining partial surfaces.

It will be seen from FIG. 2 that the aspheric partial surfaces 16 and 17 and 17' are mutually staggered or shifted relative to each other in the direction parallel to the optical axis 12 of the headlamp whereby the resulting step 19 is rounded, that means it has a rounded edge 20 transiting into the partial surface 17 and a concave edge 21 transiting into the adjoining partial surface 16. The asphericity of the adjoining partial surfaces 16 and 17 (or 17') can be the same or can differ one from the other.

Figure 3:
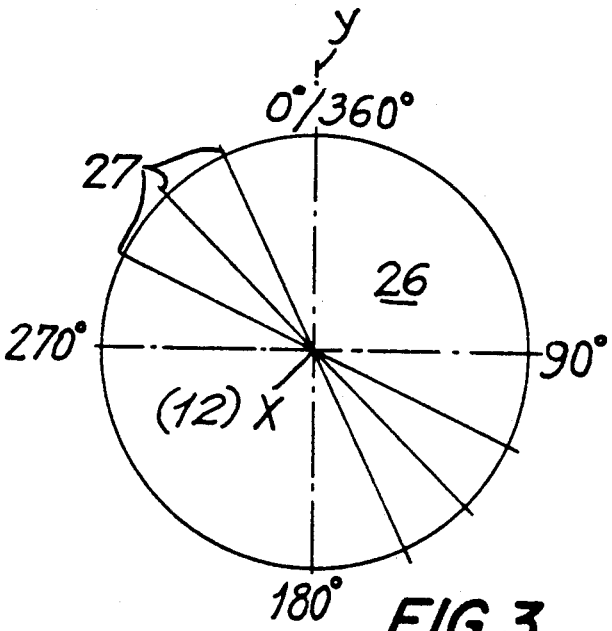
FIG. 3 is an elevation view of a second embodiment of an objective.
Figure 3A:
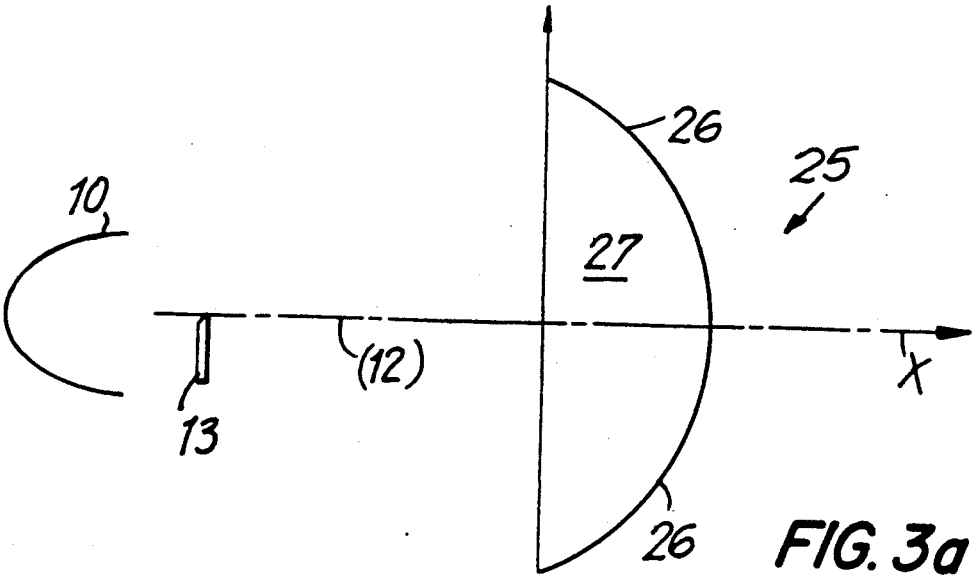
FIG. 3*a* is a side view of the objective of FIG. 3.

In the embodiment of an aspheric objective 25 illustrated in FIGS. 3 and 3*a*, one side 26 of the objective is not rotation symmetrical with respect to a center axis x corresponding to the optical axis 12. Axial sections 27 of the side 26 continuously change in accordance with at least one variable parameter of a corresponding lens formula. For example, in the lens formula $$x = \frac{c \cdot y^2}{1 + \sqrt{1 - q \cdot c^2 \cdot y^2}}$$

the variable parameters are c and/or q, wherein c is curvature of the side 26 (i.e. 1/radius), q is a correction factor and x is the height of the arc of the side 26 defined as a function of a distance y, from the axis 12.

The aspheric shape of the side 26 of the objective varies in such a manner that at 90° (relative to a y axis which is normal to the optical axis 12) a maximum deviation of the aspheric shape relative to 0° corresponding to the y axis is achieved.

In the embodiment of FIG. 4, the objective 35 has a convex side 37 and a planar side 36 facing the reflector 10 (FIG. 1). The planar side 36 is integrally connected with optical means in the form of light dispersing profiles namely with alternating array of annular concave lenses 38 and convex lenses 39. The lens array 36 and 39 is concentric or rotation symmetric relative to the optical axis 12. Instead of the alternating arrangement of concave and convex lenses it is also possible in a modified version of this embodiment to provide on the planar surface either concave lenses or convex lenses. In still another modification the planar side of the objective can be replaced by a slightly curved side, preferably a concave side formed with the light dispersing profiles.

Figure 5:
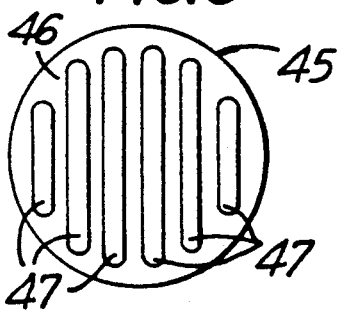
FIG. 5 is a rear view of a modification of the objective of FIG. 4.

In the modification illustrated in FIG. 5, the objective 45 is provided on its side 46 facing the reflector with an array of upright linear profiles 47, preferably in the the form of cylindrical lenses.

Figure 6:
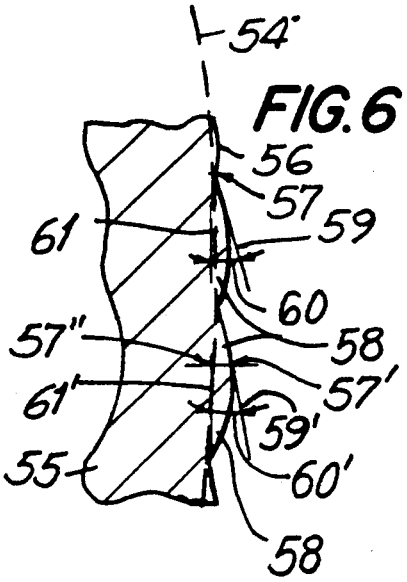
FIG. 6 is an axial section of a cutaway part of still another embodiment of an objective, shown on a strongly enlarged scale.

In the embodiment of an objective 55 shown in FIG. 6, the objective together with the integrated optical means is made of pressed glass or plastic material. Similarly as in the preceding embodiments, the objective has an aspheric partial surface 56 which in addition is provided with integrally formed optical means 58 constituting so-called microelements, particularly microelevations. Such microelements 58 are usually designated as a "pitting" or "orange peel structure". The effect of the microelements 58 is the introduction of a desired nonsharpness (substaning) of the light-dark boundary zone of the light beam projected on a driveway. An angle 60, 60' included by the tangent line 59, 59' of a point 57, 57' of a microelement 58 with a tangent line 61, 61' of a juxtaposed point 57'' of an ideal contour 54 of the objective 55, should not exceed a predetermined range, for example ±5°.

Figure 7:
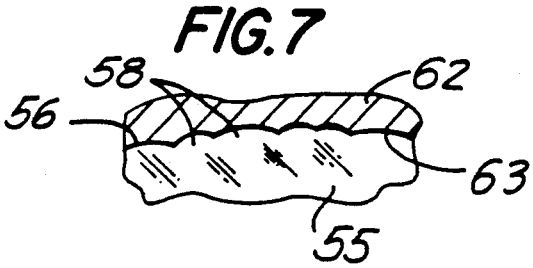
FIG. 7 is an axial section similar to FIG. 6 during its formation in a pressing mold.

FIG. 7 shows a cross section through a cutaway part of a shaping recess 63 of a pressing mold 62 in which the objective 55 is produced. The mold recess 63 is a smooth structure formed either by a nonmachining or non-cutting process such as pressing or stamping or by machining or chip removing process such as eroding, grinding, sandblasting or blow blasting. The entire surface of the forming recess 63 defines the microelements 58 of the aspheric side 56 of the objective 55.

Figure 8:
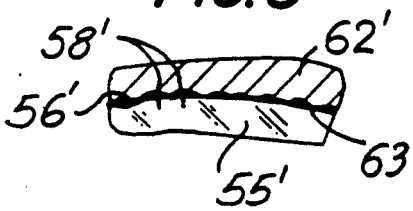
FIG. 8 is a view similar to FIG. 7 but showing another embodiment of an objective.
Figure 9A:
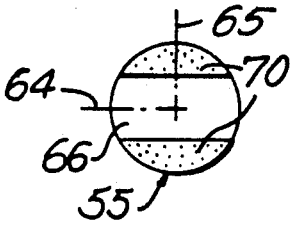
FIGS. 9*a* through 9*d* show on a reduced scale front views of different modifications of the objective of FIG. 6.
Figure 9B:
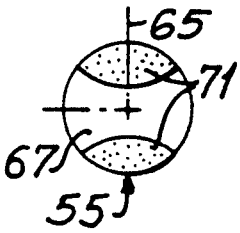
Figure 9C:
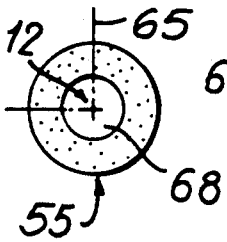
Figure 9D:
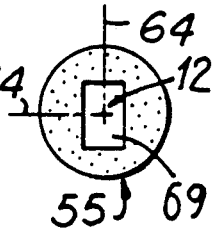

In contrast to the pressing tool of FIG. 7, the forming recess 63' of the pressing tool 62' in FIG. 8 has a rough, completely irregular structure of its surface. The rough, irregular surface has the quality that the glass or plastic material enters the depressions of the recessed surface 63' only partially, thus producing the microelements 58'.

FIGS. 9*a* through 9*d* show respectively different variations of the aspheric side 56 of the objective 55 all arranged in the same position relative to a horizontal center plane 64 and a vertical center plane 65. The aspheric side of the objective has a smooth partial surface (66 through 69) which does not disperse the passing light beam. The partial surface 66 is in the form of a horizontal strip delimited by two parallel lines 70. The partial surface 67 is a horizontal strip delimited by two arched lines 71 having the least clearance in the range of the optical axis 12 coinciding with intersection of horizontal and vertical planes 64 and 65. The partial surface 68 has a circular configuration concentrical with the optical axis 12. Finally, the partial surface 69 has the shape of an elongated rectangle whose longer sides are parallel with the upright plane 65 and its narrow sides extend parallel to the horizontal plane 64. The center of the rectangle again coincides with the optical axis 12.

While the invention has been illustrated and described as embodied in specific examples of optical means integrated with an objective of a headlamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letter Patent is set forth in the appended claims:

1. A low beam or fog headlamp for motor vehicles, comprising a reflector defining an optical axis, a light source arranged on the axis to generate in cooperation with the reflector a light beam propagating along the optical axis, a light shield arranged in the path of propagation of the light beam and having an optically effective edge, an objective concentrically arranged on the optical axis to project a partial light beam delimited by said edge as a light-dark boundary zone on a driveway, optical means formed as an integral part of said objective to adjust light distribution and/or to correct color fringes of said partial light beam, said optical means including an aspheric surface formed on at least one side of the objective, said one side of the objective having a rotationally asymmetrical configuration with respect to said optical and consecutive axial sections of said one side continuously change according to a continuous change of at least one parameter of the lens formula $$x = \frac{c \cdot y^2}{1 + \sqrt{1 - q \cdot c^2 \cdot y^2}}$$

wherein c is the curvature of said one side, q is a correction factor, and x is the height of the arc of said one side defined as a function of a vertical distance y from said optical axis.

2. A headlamp as defined in claim 1, wherein the aspheric shape of said one side changes in such a manner that a maximum deviation of the axial section occurs at 90° relative to an axis normal to said optical axis.

* * * * *